United States Patent [19]

Spears et al.

[11] 4,039,040

[45] Aug. 2, 1977

[54] STORAGE ASSEMBLIES

[75] Inventors: Peter John Spears, Pershore; Richard Grahame Dugard Showell, Bishampton, both of England

[73] Assignee: Bar Productions (Bromsgrove) Limited, Bromsgrove, England

[21] Appl. No.: 632,102

[22] Filed: Nov. 14, 1975

[30] Foreign Application Priority Data

Nov. 15, 1974 United Kingdom ..... 49334/74

[51] Int. Cl.[2] ..... A47B 53/00

[52] U.S. Cl. ..... 180/96; 200/61.44; 312/201; 104/148 R

[58] Field of Search ..... 180/96; 214/44, 16.1 CC; 104/1 R, 148, 147; 312/198–202; 200/61.44, 330

[56] References Cited

U.S. PATENT DOCUMENTS

| | | | |
|---|---|---|---|
| 3,829,189 | 8/1974 | Staller | 312/200 |
| 3,890,903 | 6/1975 | Showell | 318/264 |
| 3,957,323 | 5/1976 | Tucker et al. | 104/148 R |

*Primary Examiner*—Joseph F. Peters, Jr.
*Assistant Examiner*—J. D. Rubenstein
*Attorney, Agent, or Firm*—Scrivener, Parker, Scrivener and Clarke

[57] ABSTRACT

A storage assembly in which a row of storage units, such as racks, are movable between fixed limits along the length of the row in either of two opposite directions so that a gangway can be provided between the sides of any two adjacent units, and in which each storage unit is provided with a set of reversible electric motors adapted to drive individual independently rotatable drive wheels to move that storage unit, and a set of switches is provided along each side of each storage unit so as to be operated by means at the side of an adjacent storage unit, each switch in each set being associated with a respective reversible motor in the vicinity of the switch so as to control operation of that motor independently of the others and to cut-off the supply of electricity to the motor when it is operated. Thus each motor will continue to operate to move the part of the unit by which it is carried until that part reaches a datum position defined by the side of an adjacent storage unit. Adjacent storage units will therefore be maintained in constant relative positions and a gangway of constant width throughout its length will be provided. Provided the fixed limits at opposite ends of the row are parallel, the gangway will be parallel sided.

23 Claims, 9 Drawing Figures

Figures 1, 8:
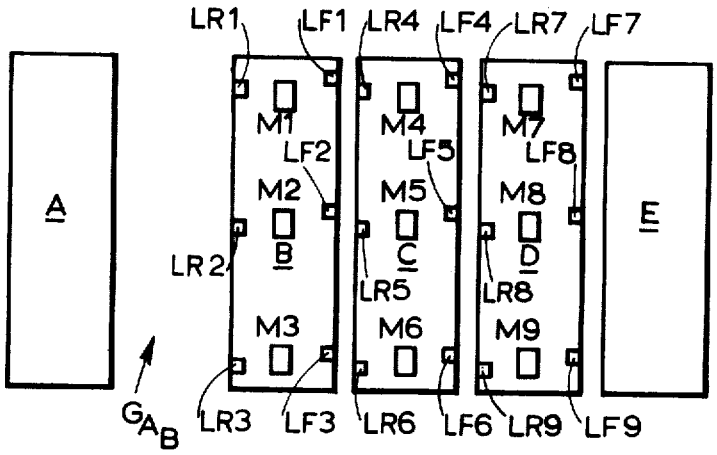

| | GANGWAY | | | |
|---|---|---|---|---|
| | $G_{AB}$ | $G_{BC}$ | $G_{CD}$ | $G_{DE}$ |
| SS1 | X | X | X | X |
| SS2 | X | | | |
| SS3 | | X | | |
| SS4 | | | X | |
| SS5 | | | | X |

STORAGE ASSEMBLIES

This invention relates to storage assemblies of the kind in which a row of storage units, such as racks, are movable between fixed limits along the length of the row in either of two opposite directions so that a gangway can be provided between the sides of any two adjacent units, each storage unit being provided with a set of reversible electric motors adapted to drive individual independently rotatable drive wheels to move that storage unit.

In known storage assemblies of the kind set forth, each storage unit is provided along each side of its base opposite the bases of adjacent storage units with trip bars which operate switch means to cut off the supply of electricity to all the motors on that storage unit when one of the trip bars engages an adjacent trip bar or an obstruction, thereby stopping movement of the storage unit in that direction.

Due to uneven loading of storage units, differences between the frictional engagements of different wheels with the ground and the build-up of dirt on the rolling diameter of the wheels, there may be a tendency for one end or section of a storage unit to have been moved through a smaller distance than the opposite end or remaining section or other parts at the instant a trip bar is operated to stop movement of the storage unit in a particular direction. Thus when the trip bar is operated by engagement with a trip bar on an adjacent storage unit, the gangway produced by movement of that storage unit will be uneven, at least on one side. Such an effect is particularly likely to occur when the unit is of substantial length, for example 75 feet. This may obstruct the gangway causing difficulty in loading and unloading articles into and from the storage units on opposite sides of the gangway. In particular, a gangway of uneven width prevents the correct operation of turret trucks and order pickers of the kind which have means at their sides which project laterally and engage guide means at the bases of the storage unit so as to guide the truck or picker.

According to the invention, in a storage assembly of the kind set forth a set of switches is provided along each side of each storage unit so as to be operated by means at the side of an adjacent storage unit, and each switch in each set is associated with a respective reversible motor in the vicinity of the switch so as to control operation of that motor independently of the others and to cut-off the supply of electricity to the motor when it is operated.

Thus each motor will continue to operate to move the part of the unit by which it is carried until that part reaches a datum position defined by the side of an adjacent storage unit. Adjacent storage units will therefore be maintained in constant relative positions and a gangway of constant width throughout its length will be provided. Provided the fixed limits at opposite ends of the row are parallel, the gangway will be parallel sided.

Preferably, the switches of each set are mounted at spaced intervals along the sides of the bases of the storage units and are operated to cut-off the supply of electricity to their respective motors by contact with a trip bar carried on the base of an adjacent storage unit opposite the switches.

In one embodiment, the switches in each set are mounted along the rear of a respective trip bar and are operated by cam means carried along the front face of a trip bar on an adjacent storage unit, the cam means engaging the switches through respective apertures in the trip bar carrying the switches. Each trip bar on a mobile storage unit therefore carries a set of switches along its rear face and a set of cams along the front face. Preferably, the cams and switches are adjustable in the direction of movement of the storage units so as to allow adjustment of said datum.

In an alternative embodiment, the switches in each set are mounted along the side of the base of the storage unit and are operated by a trip bar on an adjacent storage unit, the switches and trip bar along the side of any one mobile storage unit being in different horizontal planes including the trip bar and switches, respectively, on the adjacent storage unit. With this embodiment, the trip bars on the opposing sides of adjacent storage units can be arranged so that, as the storage units come together, the trip bars overlap before the switches on the moving storage unit are operated. The storage units then stop with a smaller spacing between them.

Besides operating the sets of switches so as to give a constant width gangway, as described above, the trip bars preferably serve the separate function of stopping the storage units when they engage obstructions, switch means being mounted behind each trip bar so as to be operated thereby when the trip bar is moved by engagement with an obstruction and then serving to interrupt the power supply to the set of motors driving the storage unit.

Figure 2:
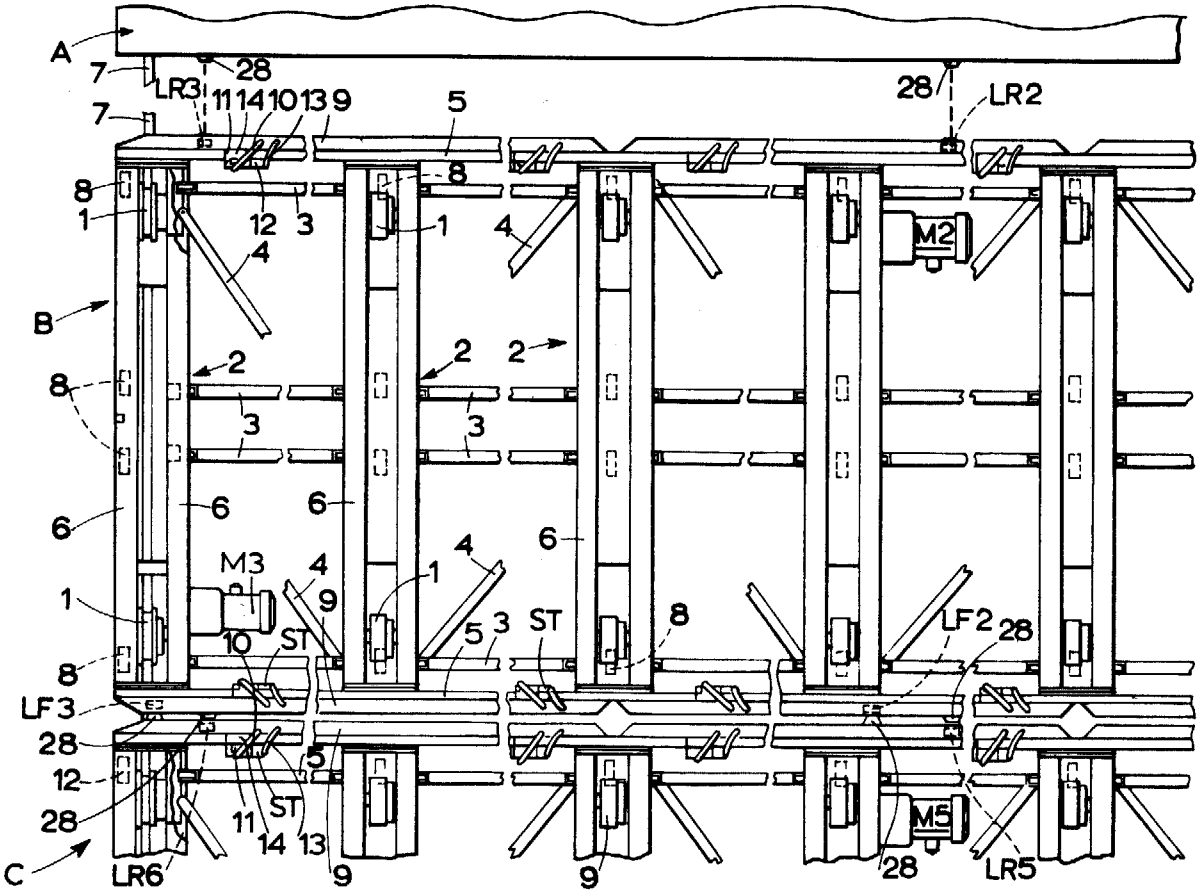
Figure 3:
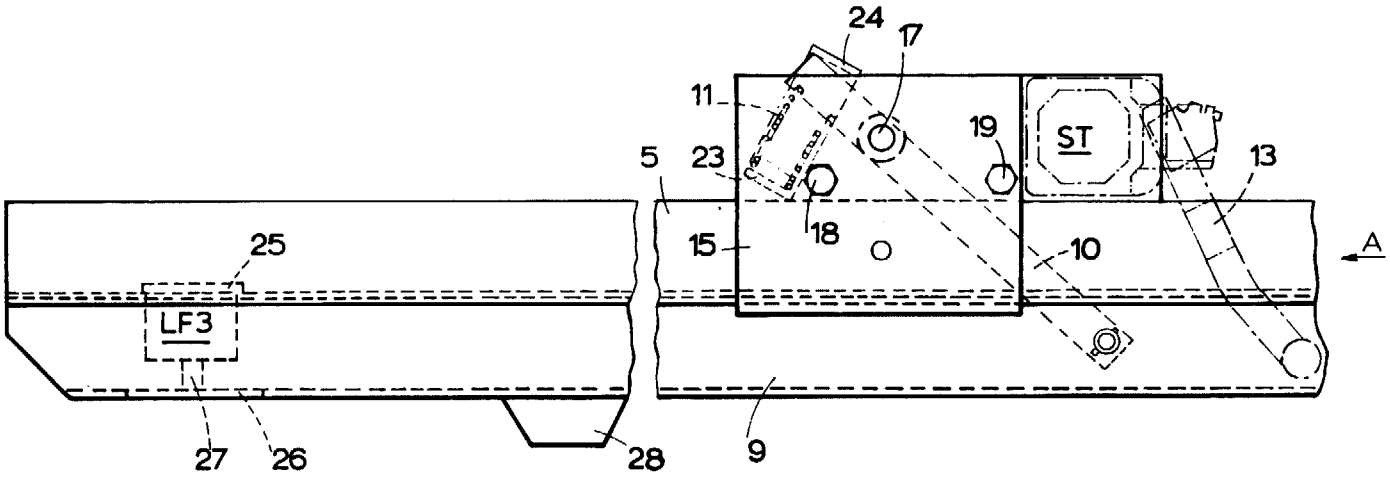
Figure 4:
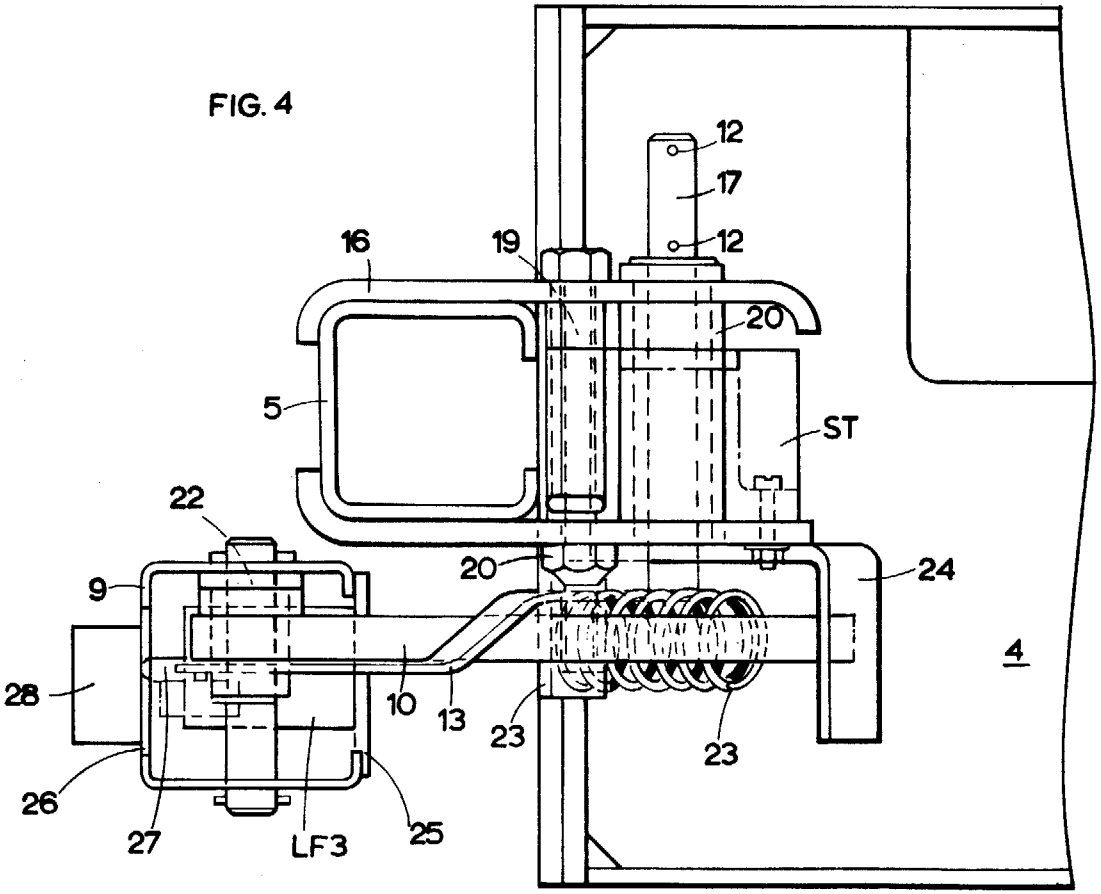
Figure 9:
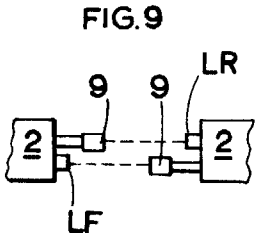

The invention will now be described by way of example with reference to the accompanying drawings in which:

FIG. 1 is a schematic plan view of a storage assembly according to one embodiment of the invention, FIG. 2 is a plan view to an enlarged scale of parts of adjacent storage units in FIG. 1, FIG. 3 is a plan view to an enlarged scale of the side of a mobile storage unit as shown in FIG. 2, FIG. 4 is a side view looking in the direction of arrow A in FIG. 3, FIGS. 5 to 7 show the control circuitry for the storage assembly of FIGS. 1 to 4, FIG. 8 is a diagram showing the operating programme of the gangway selection means, and FIG. 9 is a side view of an adjacent pair of mobile storage members in an alternative embodiment of the invention.

The storage assembly shown in FIG. 1 comprises a row of storage units including two fixed end units in the form of upright storage racks A, E and three intermediate mobile units B, C, D each comprising a mobile base which supports an upright storage rack having storage space on both sides and which is movable along the length of the row to open or close a gangway G between any two of the storage units.

Each mobile base has a series of ground engaging wheels 1 along either side and three reversible electric motors M, one being provided at each end of the base to drive a respective wheel at that end of the base and one being provided at a central region of the base to drive a wheel in this region. A set of three stop switches LR and LF is provided along each side of each base and each switch in each set is positioned in the region of a respective motor M and is arranged so as to be operated by engagement with the adjacent storage unit. Further, each switch is connected in a control circuit with its respective motor so as to control movement of the base in the corresponding direction to that side of the centre-line of the base on which the switch lies, movement being stopped or prevented when the switch is operated.

For example, the base of the mobile storage unit B has three switches LR1, LR2 and LR3 mounted along its left-hand side as seen in FIG. 1 and three switches LF1, LF2 and LF3 mounted along its right-hand side, these switches controlling the three motors M1, M2 and M3, respectively. With unit B in the illustrated position the switches LF1, LF2 and LF3 are all operated by engagement with the base of the adjacent unit C, whereupon none of the motors can be energised to drive unit B to the right. However, the switches LR1, LR2 and LR3 are all unoperated, and therefore the motors are energised to drive unit B to the left when another gangway is selected. The motors then continue to operate until unit B closes on the fixed unit A, whereupon each of the switches LR1, LR2 and LR3 is operated by engagement with unit A and de-energises its respective motor M1, M2 and M3. The three switches LR1, LR2 and LR3 are now operated and prevent the motors from driving unit B to the left and the three switches LF1, LF2 and LF3 are unoperated and allow the motors to be energised to drive unit B to the right. The switches LR4 to LR6 and LF4 to LF6 similarly control the motors M4 to M6 on unit C, and the switches LR7 to LR9 and LF7 to LF9 control the motors M7 to M9 on unit D.

It will be appreciated that a pair of stop switches LF, LF controls each motor M of a unit independently of the other motors so that the motor continues to drive that part of the unit on which it is mounted until that part closes on an adjacent unit and the corresponding one of the switches LR, LF is operated to stop the motor. Thus the three motors on each unit serve to drive the unit until it has closed on an adjacent unit and assumes a position parallel to it. The gangway produced between the units is then necessarily of a substantially constant width provided the outermost fixed units A and E are parallel to one another.

The construction of each mobile base is illustrated in FIG. 2 which shows a plan view of the left-hand end of the base of unit B. The base comprises a framework of wheel supporting sections 2 which are connected by channel-section cross-members 3 and tie bars 4 between adjacent sections 2, and side members 5 which each span across and are connected to the ends of neighbouring sections 2. Each section 2 includes a pair of channel-section members 6 which are connected back-to-back with a space therebetween for the wheels 1 which are mounted in bearings in the webs of the channel-section members 6. The end sections 2 each support a pair of flanged wheels 1 which run on a respective guide rail 7, and each of the intermediate sections 2 supports a pair of ground engaging wheels 1. One of the reversible electric motors M is mounted on each end section 2 and on the central intermediate section 2 so as to drive one of the wheels 1 through suitable gearing.

The storage rack which is mounted on each base has upright members which are connected to the sections 2 at their lower ends in positions 8, as shown in broken lines in FIG. 2, each bay of the rack corresponding to the spacing between the sections 2. The upper side flanges of the channel-section members 6 and the uppermost web of the cross members 3 all lie in the same horizontal plane which thereby defines the lowermost shelf of the rack.

Figure 5:
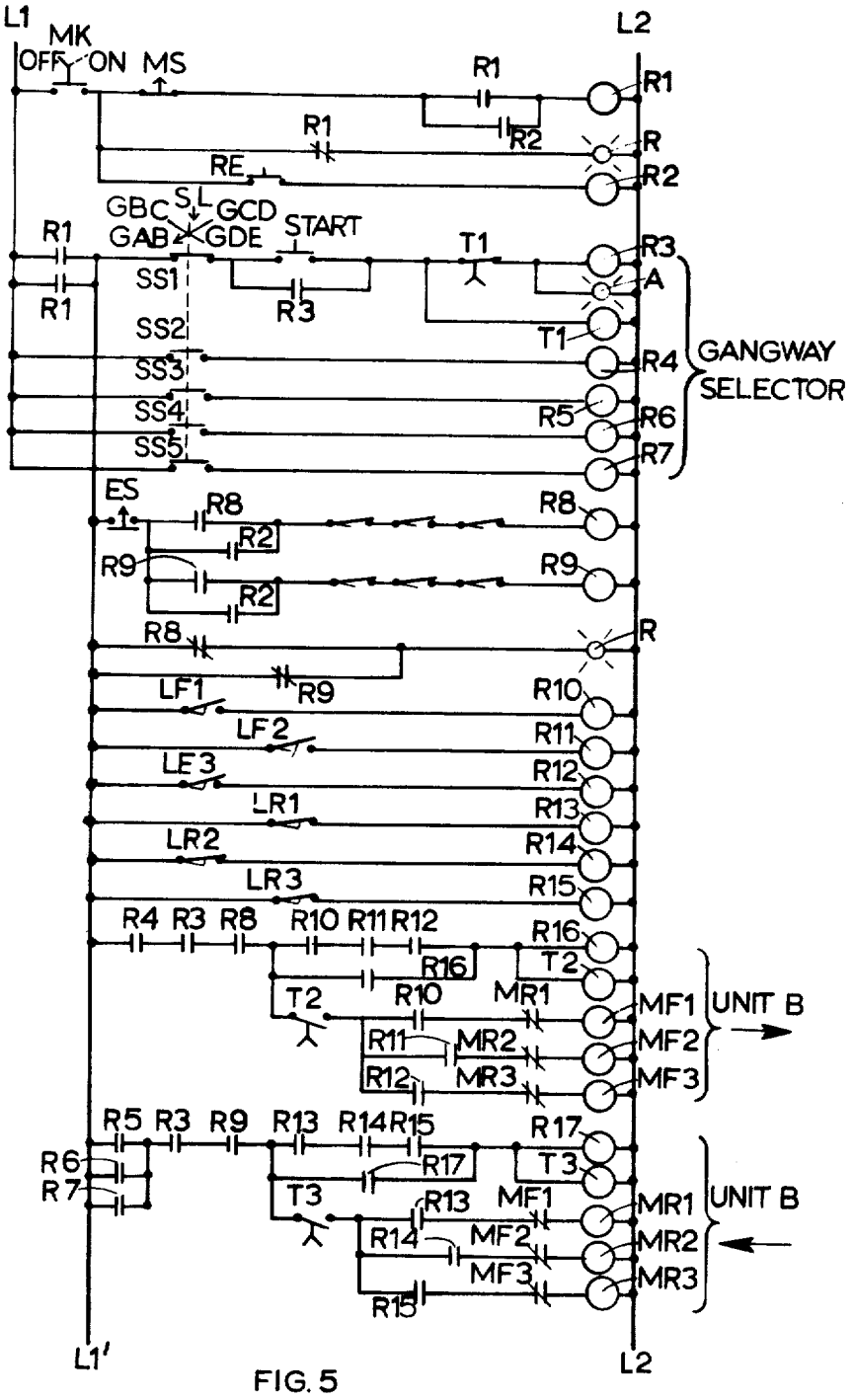

Three trip bars 9 are mounted on the respective side members 5 so as to extend end-to-end along the whole side of each mobile base parallel with the side members, the trip bars on all of the bases lying in substantially the same horizontal plane. Each trip bar 9 is mounted on a respective side member 5 by a pair of equi-length parallel links 10 such that the centers of the pivotal connections of the links to the side member and trip bar at respective opposite ends define a parallelogram, whereby the trip bar is constrained to assume positions parallel to the side member as it swings on the links towards and away from the side member. A spring 11 acts on each link 10 to urge the trip bar away from the side member to a forwardmost position, and a switch ST is associated with each link 10 and has an operating arm 13 which is operated by rearward movement of the trip bar towards the side member on engagment of the trip bar with an obstruction in the gangway. The trip switches ST are connected in the control circuit with the motors M of the respective base, as shown in FIG. 5, and serve to de-energise these motors when the switches are operated.

Each of the links 10 is pivotally connected to the side member 5 by connection means 14 which can be releasably fastened to the side member anywhere along a part of its length so that the spacing of the pivot centres between the links and side member can be adjusted at will to match the position of the pivot centres between the links and the trip bar, thereby forming the necessary parallelogram configuration.

As illustrated in FIGS. 3 and 4, the connection means 14 takes the form of clamp means comprising two plates 15, 16 which engage the side member 5 top and bottom and support a vertical pivot pin 17 therebetween which is welded to the link 10 at its lower end and can assume either of two vertical positions depending on whether or not the lower of two split pins 12 is provided through it. A pair of bolts 18, 19 extends through both plates 15, 16 and are threaded in nuts 20 welded to the lower plate 15 so as to pull the plates together. The pivot pin 17 also extends through a space sleeve 21 which is positioned between the plates 15, 16 so as to hold them apart and prevent jamming of the pivot pin.

Each link 10 extends forwards of the side member 5 and is connected to the trip bar 9 at its outer end by a pivot pin 22 so that the trip bar lies below the side member 5 and can swing inwards beneath the latter. The coil spring 11 acts between a fixed stop 23 on the lower plate 15 of the clamp and the inner end of the link 10 beyond the pivot pin 17 so as to urge the inner end of the link against a fixed stop 24, in which position the trip bar extends forwards of the side member 5 to a maximum extent. The stop 24 therefore limits forward movement of the trip bar.

The electrical switch ST is mounted on the lower clamp plate 15 and the operating arm 13 extends forwards to a position adjacent the rear face of the trip bar.

The trip bars 9 have a C-shaped channel-section with the web vertical and facing outwards to engage any obstruction in the gangway. One of the stop switches LR, LF is mounted within each trip bar in the vicinity of its respective motor M. Each stop switch is mounted on a bracket 25 which is connected across the opening in the rear of the trip bar adjacent an aperture 26 in the web of the trip bar so that the operating probe 27 of the switch projects forwards substantially into the plane of the web. Further, opposing trip bars on adjacent mobile bases are each provided with a cam 28 on its front faces which is aligned with the stop switch carried by the adjacent trip bar so as to operate the switch through engagement with the operating probe 27. The trip bars on mobile bases B and D adjacent the fixed storage units A and E do not carry cams 28, but the bases of the fixed units A and E each carry three cams 28 in positions aligned with the switches LR1 to LR3 and LF7 to LF9, respectively, so as to operate them through engagement with the operating probes 27. Thus, the stop switches LR and LF carried by the trip bars are operated before the trip bars can be moved by engagement with an adjacent trip bar or storage unit. The trip bars therefore normally remain stationary relative to their respective bases and only move when engaged by an obstruction in a gangway, whereupon the trip switches ST behind the moved trip bar are operated and disconnect power from the motors M.

Figure 6:
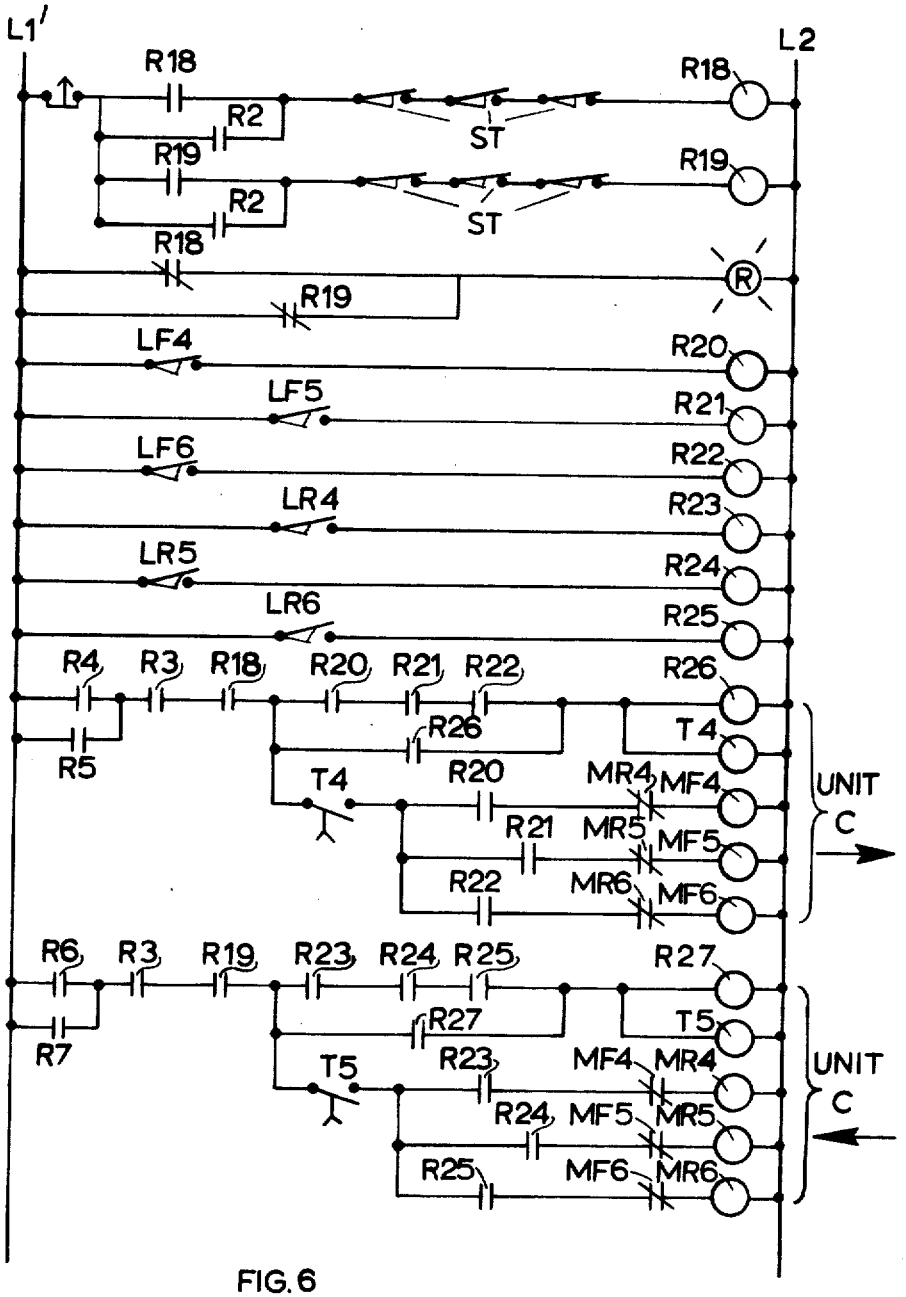
Figure 7:
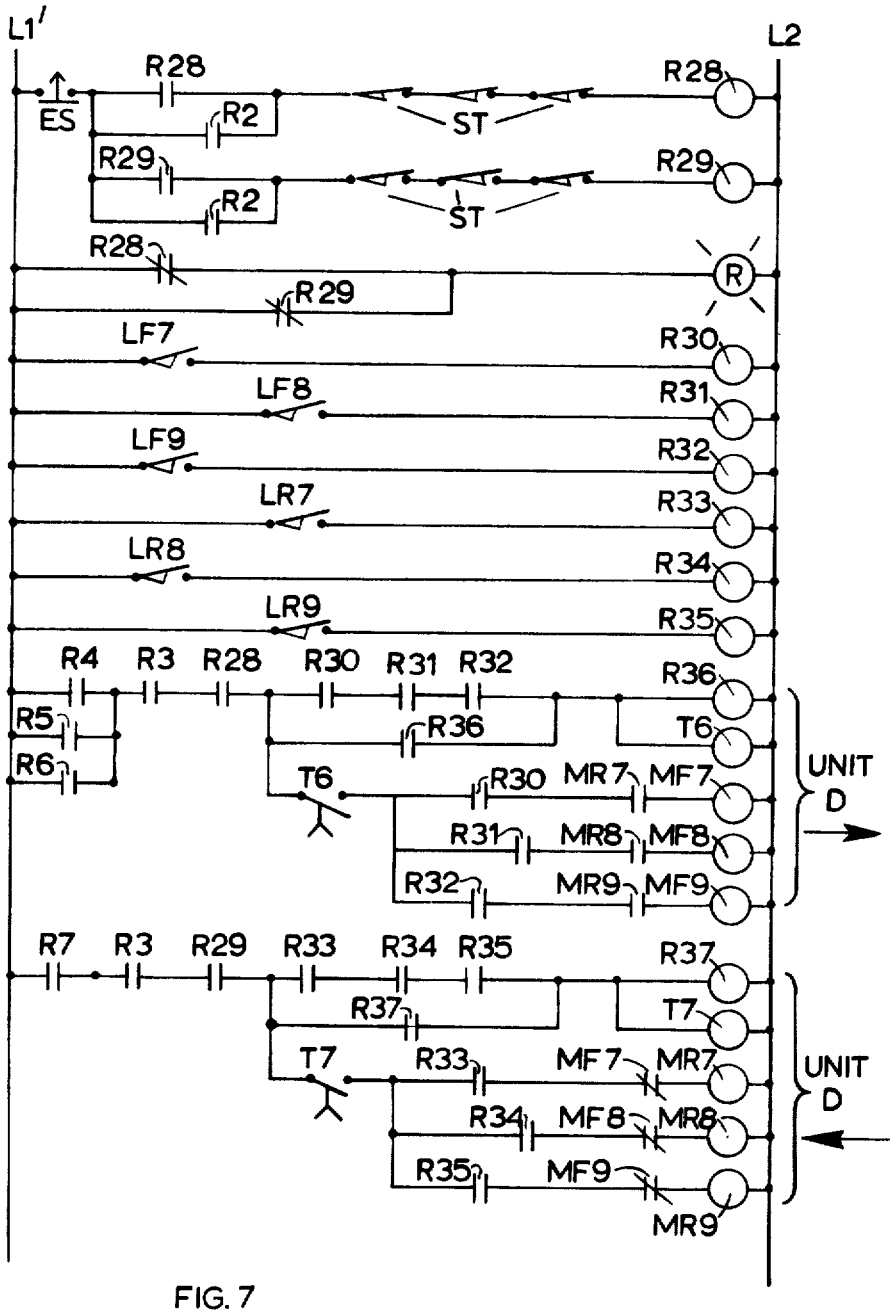

The control circuitry for the motors M, including the stop switches LR, LF and the trip switches ST, is shown in FIGS. 5 to 7. The circuitry includes gangway selection means (FIG. 5) comprising a manually operable selector SL which can be set to any one of four angular positions corresponding to the four gangways $G_{AB}$, $G_{BC}$, $G_{CD}$ and $G_{DE}$ and which controls the setting of five selector switches SS1 to SS5 in a predetermined manner as shown in the programme diagram of FIG. 8 in which a cross indicates that the corresponding selector switch is closed. Each of the selector switches SS2 to SS5 is connected in series with a respective relay R4 to R7 across the circuit power lines L1, L2 and these relays R4 to R7 control associated switch contacts in individual motor control circuits each associated with a mobile storage unit B, C or D and controlling movement of that unit in one particular direction as indicated by the arrows in the drawings.

FIG. 5 shows the gangway selector set following selection of gangway $G_{AB}$ as shown in FIG. 1. Only selector switch SS2 is closed, whereupon relay R4 is energised and holds closed the switch contacts R4 in each of the motor control circuits for movement of units B, C and D towards the right. If the gangway $G_{BC}$ were selected, the selector switch SS3 would be closed and relay R5 would thereby be energised. The switch contacts R5 would then be held closed to allow movement of unit B to the left and movement of the units C and D to the right. Similarly, if the gangway $G_{CD}$ were selected, the selector switch SS4 would be closed, thereby energising relay R6 and closing the switch contacts R6 to allow movement of units B and C to the left and unit B to the right; and if the gangway $G_{DE}$ were selected, the selector switch SS5 would be closed, thereby energising relay R7 and closing the switch contacts R7 to allow movement of all three units to the left. Where a motor control circuit, such as that for leftward movement of unit B, includes two or three switch contacts of the selector relays R4 to R7, these are connected in parallel in the circuit so that each controls the circuit independently of the other.

As indicated above, the selector switches SS2 to SS5 are connected directly across the power supply lines L1, L2. However, the rest of the control circuitry is connected to the power lines L1, L2 under the control of a master key switch MK and a normally open reset switch RE. When the switch MK is closed and the switch RE is pressed and released, the relay R2 is energised momentarily and this in turn closes a switch contact R2 to energise a relay R1 in series with switch MK and a master stop relay MS. Once energised, the relay R1 holds itself energised through its own switch contact R1 across switch contact R2. Also, energisation of relay R1 causes closure of two more of its switch contacts R1, which thereby connect the live line L1 to the rest of the control circuitry, including a start circuit. The start circuit includes the selector switch SS1, a start switch SR, a relay R3 and a timer T1. When the start switch SR is closed, relay R3 is energised and holds itself energised by closure of its switch contact R3 across the start switch. While relay R3 is energised, it closes further switch contacts R3 in each of the individual motor control circuits as so to allow energisation of the associated motors. Closure of the start switch SR also causes the timer T1 to operate, and after a predetermined time which is sufficient to allow movement of the units to give any selected new gangway, timer T1 opens switch T1 momentarily to de-energise relay R3.

The three trip switches ST along each side of each mobile unit are connected in series with a corresponding relay which controls a switch contact in the motor control circuit controlling movement of that unit in that direction towards the switches from the centre line of the unit. For example, the switches ST along the right hand side of unit B are connected in series with a relay R8 which controls a switch contact R8 in the motor control circuit controlling movement of unit B towards the right, and the switches ST along the left-hand side of unit B are connected in a series circuit with a relay R9 which controls a switch contact R9 in the motor control circuit controlling movement of unit B towards the left. These switches ST are normally closed and are further connected in series with a switch contact R2 of relay R2 which is momentarily energised by operation of the reset switch R5, as described above. Thus operation of the reset switch RE causes the trip relays to be energised and these then hold themselves energised through switch contacts connected across the switch contacts R2. An emergency stop switch ES is also connected in series with both sets of switches ST carried by each unit. Movement of a trip bar on engagement with an obstruction, opens the associated switch ST, thereby de-energising the associated relay and stopping movement of the unit. Once the obstruction has been cleared, the reset switch RE is operated to re-energise the trip relays.

Each of the stop switches LF, LR is connected in series with a corresponding relay, and the relays of each set of three stop switches along one side of a mobile unit control switch contacts in the corresponding motor control circuit controlling movement of that unit in that direction towards the stop switches from the centre line of the unit. For example, the three stop switches LF1, LF2 and LF3 along the right-hand side of unit B are connected in series with relays R10, R11 and R12 respectively, and these relays control the switch contacts R10, R11 and R12 in the motor control circuit controlling movement of unit B towards the right. Similarly, the three stop switches LR1, LR2 and LR3 along the left-hand side of unit B are connected in series with relays R13, R14 and R15 respectively, and these relays control the switch contacts R13, R14 and R15 in the motor control circuit controlling movement of unit B towards the left.

In particular, two sets of switch contacts are controlled by the stop relays in each motor control circuit, one set being connected in series and controlling energisation of an operating relay connected in parallel with a timer, and each of the other set being connected in series with a separate relay MR, MF which controls a respective motor M. For example, the stop relays R13, R14 and R15 have two sets of switch contacts R13, R14 and R15, one of which is connected in series with the operating relay R17 and serves to energise the latter when they and one of the selector switch contacts R5, R6 and R7 and the switch contacts R3 and R9 are closed. Once energised, the operating relay R17 holds itself energised by closing the switch contacts R17 across said one set of switch contacts R13, R14 and R15. The timer T3, which is connected in parallel with the operating relay R17, operates while the latter is energised and after a predetermined time closes a switch T3 which connects the second set of switch contacts R13, R14 and R15 to the closed switch contacts R3, R9 and R5, R6 or R7. Each of the switch contacts R13, R14 and R15 of this second set is connected in series with a separate respective relay MR1, MR2 and MR3 which is energised by closure of switch T3 and causes a respective one of the motors M1, M2 and M3 to operate in the sense to drive the unit B to the left.

Therefore, starting from the state shown in the drawings with gangway $G_{AB}$ selected and only the stop switches LR1, LR2 and LR3 closed (the others being opened by engagement with their respective cams 28), and assuming the gangway selection mechanism is operated to select gangway $G_{BC}$, the selector switch SS3 is now closed in place of selector switch SS2 and the selector relay R5 is energised. As a result the switch contacts R5 are closed, the operating relay R17 is energised and a short time thereafter the motors M1 to M3 on unit B are energised to drive the unit to the left as described in the preceding paragraph. Movement of unit B then continues until each of the stop switches LR1, LR2 and LR3 along the left-hand side of unit B engages its respective cam 28 on unit A and is opened. Each stop switch then de-energises its respective relay R13, R14 and R15 and these in turn open their respective switch contacts R13, R14 and R15 to de-energise each of the relays MR1, MR2 and MR3 to stop each of the respective motors M1, M2 and M3 separately.

If, starting from the original state with gangway $G_{AB}$ selected, the gangway $G_{CD}$ is selected instead of the gangway $G_{BC}$, the selector switch SS4 is closed instead of the selector switch SS3. The relay R6 is therefore energised and the selector switch contacts R6 are closed instead of selector switch contacts R5. However, as the selector switch contacts R5 and R6 are connected in parallel in the motor control circuit for leftwards movement of unit B, the effect is the same as far as unit B is concerned and this moves to the left.

Once unit B is moved sufficiently far from unit C for the stop switches LF1 to LF3 and LR4 to LR6 to disengage from their respective cams 28, these stop switches close. Closure of the stop switches LF1 to LF3 energises the stop relays R10 to R12 but this has no effect as the motor control circuit including the respective switch contacts R10 to R12 has only the selector switch contacts R4 which are open. However, closure of the stop switches LR4 to LR6 (FIG. 6) energises the relays R23 to R25 which in turn close their switch contacts R23 to R25 in the leftwards movement control circuit for unit C. The switch contacts R6 in this circuit are also closed by virtue of closure of the selector switch SS4 for gangway $G_{CD}$, and therefore the operating relay R27 is energised and after a delay determined by timer T5 the relays MR4 to MR6 are energised causing the motors M4 to M6 to drive unit B to the left. Unit C then continues to move until it closes on unit C and each of the stop switches LR4 to LR6 are opened by engagement with their respective cams 28 on unit B. It will be appreciated that timer T5 introduces a delay between the start of movement of each of the units B and C so that there is no chance of unit C catching up on unit B and causing the operation of the stop switches on their adjacent sides.

The two motor control circuits associated with each unit are interlocked so that the motors M cannot receive command signals to operate in both senses simultaneously. This is achieved by arranging that each pair of relays MF and MR associated with the same motor controls normally closed switch contacts in the circuit of the other so as to open these contacts when it is energised. For example, the two motor control relays MF1 and MR1 associated with the motor M1, each control normally closed switch contacts MF1 and MR1 in the circuit of the other.

An alternative embodiment of the invention is illustrated in FIG. 9 which is similar to that of FIGS. 1 to 8 except that the trip bars 9 along adjacent sides of the mobile bases are mounted in different horizontal planes so that they will overlap, and the stop switches LR and LF are fixedly mounted on the framework of the bases along their sides so that they are operated by engagement with the adjacent trip bars. The stop switches LR, LF and the trip switches ST are arranged so that the former operate to stop the units before the latter are operated. This can be achieved by appropriate setting of the operating arm 13 of each trip switch at a distance spaced slightly from the rear of the trip bar.

In yet another alternative embodiment of the invention, the trip bars along adjacent sides of the mobile bases are mounted in different horizontal planes as shown in FIG. 9, but the stop switches LF, LR are mounted within the trip bars, as in the embodiment of FIGS. 1 to 8, and the respective cams 28 are fixedly mounted on the framework of the bases along their sides.

In any of the embodiments of the invention described above, the stop switches LR and LF and/or the cams 28 may be mounted on their respective parts so that they are adjustable in the direction of movement of the storage units.

We claim:

1. A storage assembly in which a row of storage units, such as racks, are movable between fixed limits along the length of the row in either of two opposite directions so that a gangway can be provided between the sides of any two adjacent units, and in which each storage unit is provided with a set of reversible electric motors adapted to drive individual independently rotatable drive wheels to move that storage unit, and a set of switches is provided along each side of each storage unit so as to be operated by means at the side of an adjacent storage unit, each switch in each set being associated with a respective reversible motor in the vicinity of the switch so as to control operation of that motor independently of the others and to cut-off the supply of electricity to the motor when it is operated.

2. A storage assembly as claimed in claim 1 in which each switch is operated by engagement with means at the side of the adjacent storage unit.

3. A storage assembly as claimed in claim 2 in which substantially horizontal trip bars are mounted along the sides of each storage unit so that each is movable towards the unit and serves to disconnect power from the associated motors when so moved, and in which each switch is operated by engagement with a trip bar along the side of an adjacent storage unit without causing substantial movement of that trip bar.

4. A storage assembly as claimed in claim 3 in which the trip bars on adjacent units lie in substantially the same horizontal plane and in which the switches are mounted on the trip bars so as to be operated by engagement with an adjacent trip bar.

5. A storage assembly as claimed in claim 4 in which the switches are mounted behind the front face of the trip bars and are each aligned with an aperture in the trip bar so that it can be operated therethrough.

6. A storage assembly as claimed in claim 5 in which the trip bars are of channel section and in which the switches are mounted at least largely within this channel section.

7. A storage assembly as claimed in claim 3 in which the switches are operated by engagement with respective projections on the front faces of adjacent trip bars.

8. A storage assembly as claimed in claim 3 in which the switches along each side of each unit are mounted in a different substantially horizontal plane to the trip bars along that side of the unit, and are mounted in the same substantially horizontal plane as the trip bars on the adjacent side of the adjacent unit so that each switch is operated by engagement with an adjacent trip bar.

9. A storage assembly as claimed in claim 2 in which substantially horizontal trip bars are mounted along the sides of each storage unit so that each is movable towards the unit and serves to disconnect power from the associated motors when so moved, the trip bars along the adjacent sides of adjacent units lying in different planes and the switches along each respective side being mounted on the trip bars along those sides so as to be operated by engagement with an adjacent fixed side member of the adjacent unit.

10. A storage assembly as claimed in claim 1 in which each switch is mounted on the side of the respective storage unit so as to be adjustable in opposite directions along the line of the row.

11. A storage assembly as claimed in claim 2 in which said means which each switch engages is adjustable in opposite directions along the line of the row.

12. A storage assembly as claimed in claim 3 in which at least one switch is mounted behind each trip bar so as to be operated by movement of that trip bar towards the unit on which it is mounted, this switch serving to disconnect power from all of the motors of the storage unit when operated.

13. A storage assembly as claimed in claim 1 in which each set of switches comprises one switch towards either end of the respective side of the storage unit and at least one switch at an intermediate point along this side, these switches being associated with respective motors towards the ends of the unit and at an intermediate point along its length.

14. A storage assembly as claimed in claim 1 in which the fixed limits for the row of storage units are defined by fixed members at either end of the row which extend substantially parallel to one another and perpendicular to the length of the row, the switch means along the sides of the outermost motorised storage units adjacent the fixed members co-operating with the respective fixed member so as to be operated thereby.

15. A storage assembly as claimed in claim 14 in which the fixed members each comprise part of a fixed storage unit.

16. A storage assembly as claimed in claim 1 having a control circuit in which each switch of each set controls operation of a respective first electrical switching device so that when the switch is not operated it allows the respective first electrical switching means to be operated to connect power to the respective motor so as to cause it to drive the associated storage unit in that direction to the centre line of the unit on which the set of switches lie, all of the first electrical switching devices associated with each set of switches being further controlled by at least one gangway selector switch.

17. A storage assembly as claimed in claim 16 in which each of the first electrical switching devices associated with the same motor, controls switch contacts in the circuit of the other so that they operate in a mutually exclusive manner.

18. A storage assembly as claimed in claim 16 in which each switch controls a second switching device which in turn controls the first switching device and which together with the other second switching devices associated with the same set of switches, controls operation of a timer so that the timer can be operated only when all of these second switching devices are operated by non-operation of the associated switches, the timer itself serving to allow operation of all of the associated first switching devices a predetermined time after being first operated.

19. A storage assembly as claimed in claim 18 in which each second switching device controls the associated timer through switch contacts which are connected in series with similar switch contacts of the other second switching devices, and in which a respective third switching device is connected to be operated simultaneously with each timer, this third switching device controlling switch contacts which are connected across the switch contacts of the second switching devices so that the third switching device holds itself operated once it is operated through the switch contacts of the second switching devices.

20. A storage assembly as claimed in claim 18 in which the gangway selector switch controls operation of the associated timer and first switching devices.

21. A storage assembly as claimed in claim 16 in which at least one switch is mounted behind each trip bar so as to be operated by movement of that trip bar towards the unit on which it is mounted, this switch serving to disconnect power from all of the motors of the storage unit when operated and controlling operation of the first switching devices.

22. A storage assembly in which a row of storage units, such as racks, are movable between fixed limits along the length of the row in either of two opposite directions so that a gangway can be provided between the sides of any two adjacent units, and in which each storage unit is provided with a set of reversible electric motors adapted to drive individual independently rotatable drive wheels to move that storage unit, a set of switches is provided along each side of each storage unit so as to be operated by means at the side of an adjacent storage unit, and substantially horizontal trip bars are mounted along the sides of each storage unit so that each is movable towards the unit and serves to disconnect power from the associated motors when so moved, each switch being operated by engagement with a trip bar along the side of an adjacent storage unit without causing substantial movement of that trip bar, and each switch in each set being associated with a respective reversible motor in the vicinity of the switch so as to control operation of that motor independently of the other and to cut-off the supply of electricity to the motor when it is operated.

23. A storage assembly in which a row of storage units, such as racks, are movable between fixed limits along the length of the row in either of two opposite directions so that a gangway can be provided between the sides of any two adjacent units, and in which each storage unit is provided with a set of reversible electric motors adapted to drive individual independently rotatable drive wheels to move that storage unit, a set of switches is provided along each side of each storage unit so as to be operated by means at the side of an adjacent storage unit, and substantially horizontal trip bars are mounted along the sides of each storage unit so that each is movable towards the unit and serves to disconnect power from the associated motors when so moved, the trip bars along the adjacent sides of adjacent units lying in different planes and the switches along each respective side being mounted on the trip bars along those sides so as to be operated by engagement with an adjacent fixed side member of the adjacent unit, each switch in each set being associated with a respective reversible motor in the vicinity of the switch so as to control operation of the motor independently of the others and to cut-off the supply of electricity to the motor when it is operated.

* * * * *